US005500783A

United States Patent [19]

Warda et al.

[11] Patent Number: 5,500,783

[45] **Date of Patent: *Mar. 19, 1996**

[54] CIRCUIT AND METHOD FOR CONTROLLING FASTENER APPLICATION

[75] Inventors: Gary G. Warda, 3325 Fort St., Trenton, Mich. 48183; Kenneth J. Cook, Troy, Mich.

[73] Assignee: Gary G. Warda, Brighton, Mich.

[ * ] Notice: The term of this patent shall not extend beyond the expiration date of Pat. No. 5,406,441.

[21] Appl. No.: 368,951

[22] Filed: Jan. 5, 1995

Related U.S. Application Data

[63] Continuation of Ser. No. 10,427, Jan. 28, 1993, Pat. No. 5,406,441.

[51] Int. Cl.[6] ..... H01H 47/02; B27F 7/02

[52] U.S. Cl. ..... 361/179; 227/7

[58] Field of Search ..... 361/170, 179–181, 361/195; 227/2, 5, 6, 7, 131

[56] References Cited

U.S. PATENT DOCUMENTS 3,628,714 12/1971 Offenwanger ..... 227/7
4,099,118 7/1978 Franklin et al. ..... 324/61
4,478,361 10/1984 McElhannon ..... 227/7
4,483,474 11/1984 Nikolich ..... 227/8
5,012,967 5/1991 Johansson ..... 361/190 X
5,222,645 6/1993 Sueda ..... 227/7

*Primary Examiner*—A. D. Pellinen
*Assistant Examiner*—Fritz M. Fleming

[57] ABSTRACT

A circuit and method for controlling the application of a fastener to a surface and a support, for use with a support sensor and an automatic fastener applying device. In the circuit, a comparator receives a primary signal from the sensor and generates an intermediate signal when a preselected condition is satisfied between the primary signal and the predetermined value. A controller generates a control signal in response to receipt of a secondary signal from the sensor and the intermediate signal. An actuator operates the automatic fastener applying device to apply the fastener to the surface and support in response to the control signal. The method includes comparing the primary signal from the sensor to the predetermined value, generating the intermediate signal when a preselected condition is satisfied, generating the control signal in response to the secondary signal from the sensor and the intermediate signal, and actuating the automatic fastener applying device in response to the control signal to apply the fastener to the surface and support.

12 Claims, 2 Drawing Sheets

CIRCUIT AND METHOD FOR CONTROLLING FASTENER APPLICATION

CROSS REFERENCE TO RELATED APPLICATION

This is a continuation of U.S. patent application Ser. No. 08/010,427 filed on Jan. 28, 1993, now U.S. Pat. No. 5,406,441.

TECHNICAL FIELD

This invention relates generally to fastener application. More specifically, this invention relates to a circuit and method for controlling fastener application.

BACKGROUND TO THE INVENTION

A wide variety of fasteners have been developed for use in an equally wide variety of situations. Devices for use in applying such fasteners are as varied as the fasteners themselves. Recently, in the continuing effort to increase efficiency and productivity, many such devices have been automated.

For example, a number of different fasteners may be used to secure a wall, ceiling or floor to a stud or joist. Fasteners such as screws and nails can now be applied more efficiently using automatic devices. Indeed, automatic hammers, such as that disclosed in U.S. Pat. No. 4,483,474 issued to Nickolich, are increasingly important tools in the construction industry.

Devices such as automatic hammers have generally increased productivity in the construction industry. However, their effective use is still dependant on their individual operators. To ensure proper structural integrity, a nail must be adequately centered over a stud or joist before being driven into a wall, ceiling or floor. Proper location of the nails is dependant solely on the automatic hammer operator.

While automatic hammers allow their operators to drive more nails in a given period of time than can be driven manually, this increased efficiency is at least partially offset by the delay of the operator in properly locating the nails. Many operators attempt to overcome this delay by exercising less care in locating the nails and increasing the number of nails driven. While such a procedure generally ensures that an adequate number of nails are properly secured, it again partially offsets any improved efficiency by the added cost of the excess nails used.

Devices for sensing the presence of studs or joists behind wall, ceiling or floor material are well known in the art. U.S. Pat. No. 4,099,118 issued to Franklin et al discloses such a device and is incorporated herein by reference. Such devices generally detect a stud or joist by utilizing the change in the dielectric constant of the wall, ceiling or floor material caused by the presence of a stud or joist.

However, while such sensors ensure proper nail location, they can create cumbersome and unsafe working environments when used separately with automatic hammers. This problem can be overcome by mounting the sensor directly to the automatic hammer. However, such a device still requires the operator to determine when an individual nail will be driven. As a result, without coordinating the output of the sensor to the operation of the automatic hammer, the full potential of such a device cannot be realized.

SUMMARY OF THE INVENTION

Accordingly, it is the principle object of the present invention to provide a circuit and method for controlling fastener application that increases the efficiency and productivity of such application.

Another object of this invention is to provide a circuit and method for controlling fastener application that ensures adequate fastener placement.

Yet another object of this invention is to provide a circuit and method for controlling fastener application that is simple in design and inexpensive to implement.

It is a further object of this invention to provide a circuit and method for controlling fastener application that coordinates the output of a support sensing device with the operation of an automatic fastener applying device.

In accordance with the foregoing objects, a circuit and method for controlling the application of a fastener to a surface and a support is disclosed. The circuit and method are for use with a support sensor and an automatic fastener applying device. The circuit includes comparator means, controller means, and actuator means. The comparator means receives a primary signal from the sensor, compares the primary signal to a predetermined value, and generates an intermediate signal when a preselected condition is satisfied between the primary signal and the predetermined value. The controller means generates a control signal in response to receipt of a secondary signal from the sensor and the intermediate signal. The actuator means receives the control signal and actuates the automatic fastener applying device in response thereto so that the fastener is applied to the surface and support.

The method for controlling the application of a fastener to a surface and support includes the steps of comparing the primary signal from the sensor to the predetermined value and generating the intermediate signal when a preselected condition is satisfied between the primary signal and the predetermined value. The method further includes the steps of generating the control signal in response to the secondary signal from the sensor and the intermediate signal, and actuating the automatic fastener applying device in response to the control signal to apply the fastener to the surface and support.

DETAILED DESCRIPTION OF THE INVENTION

Figure 1:
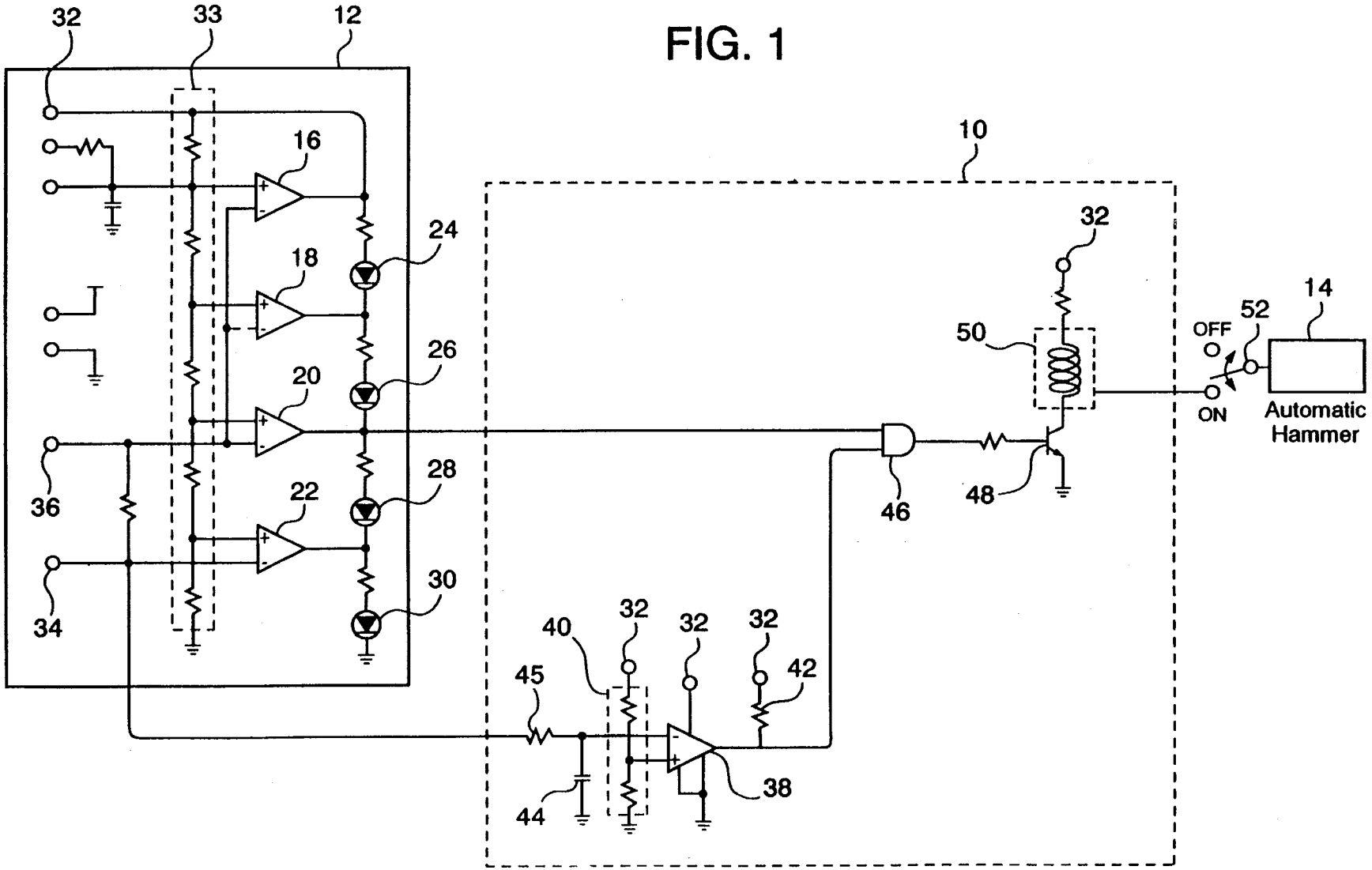
FIG. 1 is a schematic diagram of the circuit for controlling fastener application of the present invention.

Referring now to FIG. 1, the circuit for controlling fastener application of the present invention is depicted generally by reference numeral 10. For ease of explanation, the control circuit 10 is described herein for use in conjunction with a stud sensor 12 and an automatic hammer 14. As is readily apparent, however, the control circuit 10 of the present invention may be easily adapted to coordinate the operation of any automatic fastener applying device with the output of any device for sensing the presence of a support beneath a surface.

The sensor 12 detects a stud or joist by utilizing the change in the dielectric constant of the wall material caused by the presence of a stud. The sensor 12 has four operational amplifiers 16, 18, 20, 22 that drive four light emitting diodes (LEDs) 24, 26, 28, 30, respectively. One input terminal of each operational amplifier 16, 18, 20, 22 is tied to a reference voltage source 32. Through a resistive voltage divider 33, the voltage of the reference source 32 is reduced by a preselected amount for each subsequent operational amplifier 16, 18, 20, 22, such that the reference voltage associated with the operational amplifiers 16, 18, 20, 22 decreases from operational amplifier 16 to operational amplifier 22.

The remaining input terminal of each of the operational amplifiers 16, 18, 20, 22 is tied to a variable voltage source 34. The voltage of the variable source 34 depends upon the instantaneous dielectric constant of the wall material as the sensor 12 is moved toward the nearest stud. The sensor 12 is designed so that as the sensor 12 approaches a stud, the voltage of the variable source 34 decreases. As the voltage of the variable source 34 decreases below the reference voltages from the reference source 32, the LEDs 24, 26, 28, 30 light up sequentially. In so doing, the sensor 12 indicates the approach of a stud beneath the wall surface. The sensor 12 is designed so that LED 30 emits light only when the sensor 12 is directly over a stud.

However, the sensor 12 is also designed so that LED 30 also emits light momentarily during calibration of the sensor 12, due to calibration voltage source 36. LED 30 is the only LED to emit light during calibration of the sensor 12. Thus, the output of operational amplifier 22, in the form of LED 30 emitting light, does not always indicate the presence of a stud beneath the wall material. Therefore, the output of operational amplifier 22 alone is unsuitable for the purposes of actuating automatic hammer 14 to properly drive a nail.

The control circuit 10 of the present invention overcomes this problem by accessing the sensor 12 through the variable voltage source 34. Still referring to FIG. 1, the control circuit 10 of the present invention comprises an operational amplifier 38 in electrical contact with the variable voltage source 34 of the sensor 12. The variable voltage source 34 of the sensor 12 transmits a primary signal from the sensor 12 to one input terminal of the operational amplifier 38. The other input terminal of the operational amplifier 38 is tied to the reference voltage source 32 through a resistive voltage divider 40.

The resistive voltage divider 40 is ratiometric and tracks the supply voltage change impressed upon voltage divider 33. Voltage divider 40 provides operational amplifier 38 with a reference voltage value, predetermined by the resistance value of the resistors chosen for the voltage divider 40. The output terminal of the operational amplifier 38 is also connected to an output pull-up resistor 42. When the voltage of the primary signal from the sensor 12 drops below the predetermined reference voltage value, the operational amplifier 38 generates an output signal, designated herein as an intermediate signal.

The operational amplifier 38, voltage divider 40, and output pull-up resistor 42 together provide comparator means for receiving the primary signal from the sensor 12, comparing the primary signal to the predetermined value, and generating an intermediate signal when the primary signal fails to exceed the predetermined value. The operational amplifier 38, voltage divider 40, and output pull-up resistor are all conventional components well known in the art, and are designed to generate the intermediate signal when operational amplifier 22 of the sensor 12 indicates that the sensor 12 is directly over a stud beneath the wall surface.

As described herein, the operational amplifiers 16, 18, 20, 22 of the sensor 12 power their corresponding LEDs 24, 26, 28, 30 as the voltage from the variable voltage source 34 decreases below the voltage from the reference voltage source 32, as reduced by voltage divider 33. Likewise, as described above, operational amplifier 38 generates the intermediate signal when the voltage from the variable voltage source 34 decreases below the voltage from the reference voltage source 32, as reduced by voltage divider 40.

As is readily apparent, sensor 12 can also be configured such that the operational amplifiers 16, 18, 20, 22 of the sensor 12 power their corresponding LEDs 24, 26, 28, 30 as the voltage from the variable voltage source 34 exceeds the voltage from the reference voltage source 32, as reduced by voltage divider 33. With such a configuration of the sensor 12, the operational amplifier 38 can likewise be configured to generate the intermediate signal when the voltage from the variable voltage source 34 exceeds the voltage from the reference voltage source 32, as reduced by voltage divider 40.

Still referring to FIG. 1, the control circuit 10 of the present invention also comprises a conventional low pass, or passive, filtering and charging capacitor 44 in electrical contact with the variable voltage source 34 of the sensor 12 through resistor 45, and with the operational amplifier 38 through voltage divider 40. The primary signal from the sensor 12 is transmitted to the operational amplifier 38 through resistor 45 and capacitor 44. Resistor 45 and capacitor 44 together provide delay means for delaying the generation of the intermediate signal a predetermined period of time upon comparison of the primary signal to the predetermined value. The time period is determined by the RC product of the resistance of resistor 45 and the capacitance of capacitor 44. As will be discussed in further detail below, the time period for delaying the generation of the intermediate signal in the preferred embodiment of the present invention is approximately 0.1 second.

The control circuit 10 of the present invention also includes a dual input logical AND operator 46 in electrical contact with operational amplifier 20 of the sensor 12 and with operational amplifier 38. The intermediate signal from operational amplifier 38 is transmitted to one input terminal of the logical AND operator 46. The other input terminal of the logical AND operator 46 is tied to the output signal of operational amplifier 20 of the sensor 12, designated herein as a secondary signal.

As previously described, the output signals of operational amplifier 20 and 22 of the sensor 12 drive LEDs 28 and 30. Thus, the output signal of operational amplifier 20 indicates the imminent approach of a stud beneath the wall, and occurs immediately prior to the output signal of operational amplifier 22 which indicates that the sensor 12 is directly over a stud. As is readily apparent, the output signals of operational amplifiers 16 and 18 may be substituted for the output signal of operational amplifier 20 as the secondary signal from the sensor 12. However, according to experimental survey, the output signal of operational amplifier 20 is the optimum source for the secondary signal from the sensor 12.

Pursuant to its logic function, the logical AND operator 46 generates an output signal, designated herein as a control signal, upon receipt of both the secondary and intermediate signals. As a result, the logical AND operator 46 provides a controller means for receiving the secondary signal from the sensor 12 and the intermediate signal from the operational amplifier 38 and generating a control signal in response thereto. The logical AND operator 46 of the present invention is of conventional design, well known in the art.

Referring still to FIG. 1, the control circuit 10 of the present invention further comprises a transistor 48 and electromagnetic relay 50. The transistor 48 is in electrical contact with the logical AND operator 46 and relay 50, and has its emitter terminal tied to ground. The transistor 48 receives the control signal generated by the logical AND operator 46 and, upon receipt thereof, acts as a switch to activate the electromagnetic relay 50. Relay 50 is also in electrical contact with the automatic hammer 14, thereby activating the automatic hammer 14 upon receipt of the control signal by the transistor 48. The transistor 48 and relay 50 thereby provide actuator means for receiving the control signal and actuating the automatic hammer 14 in response thereto so that a nail is applied to the wall and stud. The transistor 48 and relay 50 are conventional components well known in the art.

Finally, the control circuit 10 of the present invention also comprises a conventional manually operable switch mechanism 52 in electrical contact with relay 50. In its "on" position, switch mechanism 52 allows for the coordination of the output of the sensor 12 and the operation of the automatic hammer 14. In its "off" position, switch mechanism 52 disables such coordination, thereby allowing operation of the automatic hammer 14 independently of the output of the sensor 12. Switch mechanism 52 thereby provides disabling means for disabling the electromagnetic relay 50.

In operation, with the switch mechanism 52 in the "on" position, an operator simply places the device combining the automatic hammer 14 and sensor 12 on a wall surface and continuously activates the trigger mechanism of the automatic hammer 14. As in its normal operation when functioning alone, the sensor 12 calibrates to the dielectric constant of the wall material. Once properly calibrated, the sensor 12 operates to detect a stud beneath the wall surface due to changes in the dielectric constant of the wall material caused by the presence of a stud. However, the control circuit 10 of the present invention will prevent the automatic hammer 14 from driving a nail into the wall until the sensor 12 indicates that the automatic hammer 14 has been directly over a stud for some predetermined time period. The control circuit 10 of the present invention is also designed to cooperate with any safety features present in the automatic hamer 14.

The control circuit 10 of the present invention thus allows an operator to sweep the device combining the automatic hammer 14 and sensor 12 back and forth in the vicinity of a stud beneath the wall and automatically drive nails through the wall into that stud. By delaying the firing of the automatic hammer 14 by some predetermined time period, the control circuit 10 of the present invention also ensures proper structural integrity by preventing a nail from being driven by the automatic hammer 14 until that nail is adequately centered over the stud. In the preferred embodiment of the control circuit 10 of the present invention, the predetermined period of time for delaying the firing of the automatic hammer 14 is approximately 0.1 second.

Figure 2:
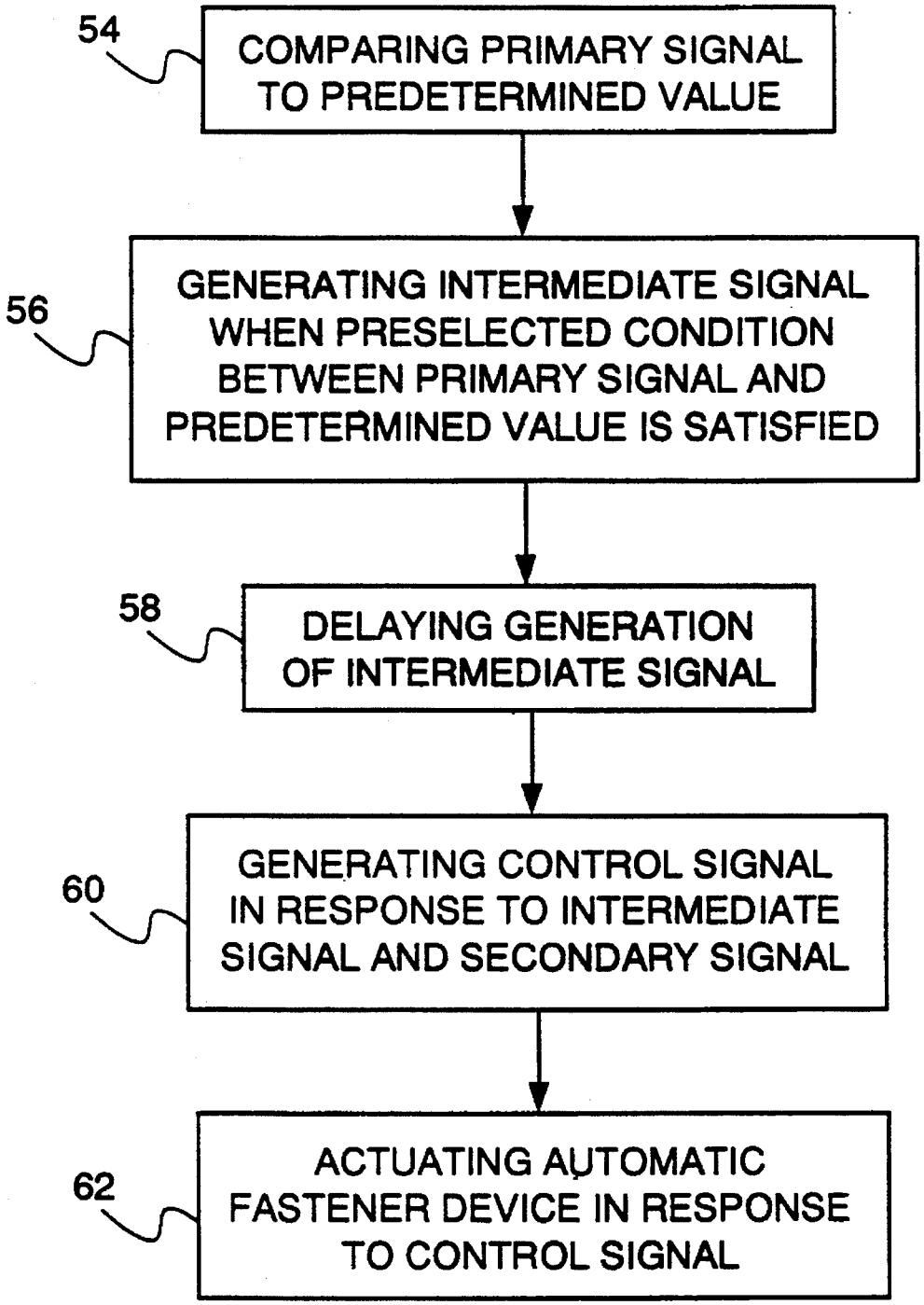
FIG. 2 is a block diagram of the method for controlling fastener application of the present invention.

Referring now to FIG. 2, a block diagram of the method of controlling fastener application of the present invention is shown. As is apparent from the detailed description of the control circuit 10 of the present invention above, the method comprises the steps of comparing 54 the primary signal from the sensor 12 to the predetermined value, and generating 56 the intermediate signal when a preselected condition is satisfied between the primary signal and the predetermined value. As described above with respect to the control circuit 10, the preselected condition may be where the primary signal decreases below the predetermined value, or where the primary signal exceeds the predetermined value, depending upon the configuration of the sensor 12.

The method of controlling fastener application of the present invention also comprises the step of delaying 58 the generation of the intermediate signal by some predetermined time period after comparison of the primary signal to the predetermined value. The method further comprises the steps of generating 60 the control signal in response to the secondary signal from the sensor 12 and the intermediate signal, and actuating 62 the automatic hammer 14 in response to the control signal to drive a nail through a wall into a stud.

The circuit and method of controlling fastener application of the present invention thus ensures proper placement for each nail driven independent of the operator of the automatic hammer 14. The circuit and method of the present invention thereby increase efficiency and productivity with respect to nail driving by eliminating both operator delay resulting from the need for proper nail placement, and the added cost of excess nails improperly secured.

Thus, it is apparent that there has been provided, in accordance with the present invention, a circuit and method for controlling fastener application that satisfies the objects and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the following claims.

We claim:

1. An automatic fastener applicator for applying a fastener to a surface and a support, the applicator comprising:

a sensor for sensing and generating an input signal indicative of the presence of the support beneath the surface;

an interface circuit for processing the input signal and generating a driver control signal; and a driver for applying the fastener to the surface and the support in response to receipt of the driver control signal;

wherein the sensor, interface circuit and driver together form a hand-held unit such that the hand-held unit is disposed on one side of the surface during operation.

2. The automatic fastener applicator of claim 1 wherein the interface circuit comprises controller means for generating the driver control signal when a preselected condition is satisfied between the input signal and a predetermined value.

3. The automatic fastener applicator of claim 1 wherein the interface circuit further comprises delay means for delaying the generation of the driver control signal a predetermined period of time.

4. The automatic fastener applicator of claim 1 wherein the interface circuit further comprises disabling means for disabling the interface circuit.

5. The automatic fastener applicator of claim 1 wherein the preselected condition between the input signal and the predetermined value is where the input signal fails to exceed the predetermined value.

6. The automatic fastener applicator of claim 1 wherein the controller means comprises:

a comparator for comparing the input signal to the predetermined value; and an electromagnetic relay in electrical contact with the driver and the comparator.

7. The automatic fastener applicator of claim 3 wherein the delay means comprises a low pass filtering capacitor and resistor configuration.

8. The automatic fastener applicator of claim 3 wherein the predetermined period of time is approximately 0.1 second.

9. The automatic fastener applicator of claim 4 wherein the disabling means comprises a manually operable switch mechanism.

10. The automatic fastener applicator of claim 1 wherein the sensor is of a dielectric constant type.

11. A method for automatically applying a fastener to a surface and a support, the method for use with a sensor, a fastener driver, and an interface circuit therebetween, the sensor, driver, and interface circuit together forming a hand-held unit such that the hand-held unit is disposed on one side of the surface during operation, the method comprising:

generating an input signal via the sensor indicative of the presence of the support beneath the surface;

comparing the input signal to a predetermined value via the interface circuit;

generating a driver control signal via the interface circuit when a preselected condition is satisfied between the input signal and the predetermined value; and applying the fastener to the surface and the support via the fastener driver in response to the driver control signal.

12. The method of claim 11 further comprising delaying generation of the driver control signal by a predetermined period of time.

* * * * *